US005217259A

United States Patent [19]

Wilen

[11] Patent Number: 5,217,259

[45] Date of Patent: Jun. 8, 1993

[54] TELEVISION PROGRAMMING APPARATUS

[76] Inventor: Richard Wilen, 135 Oval Dr., Islandia, N.Y. 11722

[21] Appl. No.: 854,706

[22] Filed: Mar. 20, 1992

[51] Int. Cl.[5] ..... B42D 15/00

[52] U.S. Cl. ..... 283/116; 283/61; 283/115; 283/117

[58] Field of Search ..... 283/34, 35, 61, 115, 283/117

[56] References Cited

U.S. PATENT DOCUMENTS

| | | | |
|---|---|---|---|
| 1,666,337 | 4/1928 | McDade . | |
| 2,239,187 | 4/1941 | Becker . | |
| 2,422,421 | 6/1947 | Kaufman . | |
| 3,001,886 | 9/1961 | Shrewsbury et al. . | |
| 3,055,117 | 9/1962 | Bernstein et al. | 434/346 |
| 3,106,029 | 10/1963 | Desmond . | |
| 3,432,943 | 3/1969 | Merkel . | |
| 4,031,850 | 6/1977 | Gantt | 116/135 |
| 4,055,011 | 10/1977 | Longenecker | 40/124.1 |
| 4,496,171 | 1/1985 | Cherry | 283/61 |
| 4,832,373 | 5/1989 | Swan | 283/115 |
| 4,856,998 | 8/1989 | Silas | 434/210 |
| 5,011,191 | 4/1991 | Gannon | 283/115 |

*Primary Examiner*—Paul A. Bell

*Attorney, Agent, or Firm*—Stephen E. Feldman

[57] ABSTRACT

A multi-sheet overlay is placed over a basic television programs listing. Two of the sheets of the overlay are removably adhered together, one sheet being a transparent sheet and the other being a non-transparent sheet. The non-transparent sheet is selectively kiss-cut so that select sections of the non-transparent sheet may be removed to expose corresponding sections of the transparent sheet and reveal selected sections of the television programs listing. Data is printed on a sheet of the overlay relating to a television system the differs from the basic television listing. By selectively removing kiss-cut sections on the overlay, multiple bits of data may be combined to provide a television programs listing for a television system differing from the system represented in the basic television programs listing.

13 Claims, 1 Drawing Sheet

TELEVISION PROGRAMMING APPARATUS

BACKGROUND OF THE INVENTION

1. Field of the Invention

The present invention relates to changing or modifying television program broadcast listings, according to preference or local television systems.

2. Prior Art

The United States has a large number of television broadcasting systems, where each system may include two or more television channels or stations. There are also television networks which broadcast their own television programs and also sell their television programs to other television stations and to television cable companies. Many cities or television broadcast areas are serviced by several different local television broadcast stations as well as one or more television cable companies. For example, the city of New York has three television cable companies, publicly broadcasts all the television networks programs and has many local television broadcasting stations. At times different cable companies will broadcast the same television program at the same time but on different channels or channel designations. At times the same television program is broadcast by different cable companies on different channels and at different times. Channel number designations throughout the television broadcast industry are not uniform.

Access by the public to several different television cable companies and to many public television broadcast stations makes the generation of a universal television program listing a highly complex problem. It has been proposed that individual television broadcast listings be published for each cable company and a general television listing be published for public broadcast television programs. This means that people with access to two or more television broadcast systems may be interrogating two or more television program listings in order to determine what is to be seen on television and the most convenient time and channel on which to view the program.

SUMMARY OF THE INVENTION

The present invention avoids the use of a plurality of different television program listings by using a multi-sheet adjustable television program grid. The invention provides a multi-sheet overlay which fits over and coordinates with the information in a basic television program grid. The adjustable overlay is a multi-sheet overlay comprising at least a substrate of transparent material, such as transparent plastic, for example, and a non-transparent or opaque sheet, with an adhesive material for adhering adjacent sheets together. Preferably, the adhesive is the type which is pressure sensitive, yet permits separation of the adhered adjacent sheets, without adversely effecting the adhesive characteristics of the adhesive on the back of the sheet, so that the adhered sheets may be separated and the sheet with the adhesive backing may be adhered to another substrate. One adhesive that may be used is the adhesive used on the popular address labels, sometimes referred to as piggy back labels. When the multi-sheet overlay is adhered together, one part of the overlay may be kiss-cut so that only one of the sheets of the overlay is cut. Thus with a kiss-cut in the opaque sheet of the overlay, a portion of the opaque sheet may be removed and a transparent section in the overlay exposed.

When the multi-sheet overlay is placed on a television program grid and the overlay is kiss-cut in selected sections, coordinating with the television program grid, removal of selected portions of the opaque sheet will expose selected data in the television program grid.

The opaque sheet of the overlay may be preprinted with local time and television stations and/or channel identifications which correspond to other data listed and/or identified on the basic grid or listing. Local time may differ from the time on the basic television grid, that is, differences between eastern time and central time, for example. Time differences may be adjusted by removal of certain predetermined kiss-cut sections of the opaque sheet.

Particular television channels, such as sports channels, for example, may be identified by the overlay using a particular number or color or letter, as desired. For example, sports channels may be color shaded with a green overlay while soap opera channels may be color shaded with a red overlay. Various sports on the sport channels may be further identified for example, 1 may be used for football, 2 may be used for baseball, 3 may be used for basketball, etc., if desired. This may be done with peal-off stamps which may be provided supplementary to the primary purpose of the kiss-cuts in the multi-sheet overlay.

The number and/or color referencing and identification may be supplemental to the general coordination of the local television channel data and information as provided through the use of the present invention. That is, the multi-sheet overlay may be kiss-cut so that selected sections that have been precolored and/or prenumbered may be removed and placed identifyingly with a particular television program or presentation in the basic listing.

The present invention provides an inexpensive multi-sheet overlay for conveniently changing a basic television program grid into a localized and/or personal television program listing.

DETAILED DESCRIPTION OF THE DISCLOSURE

Figure 1:
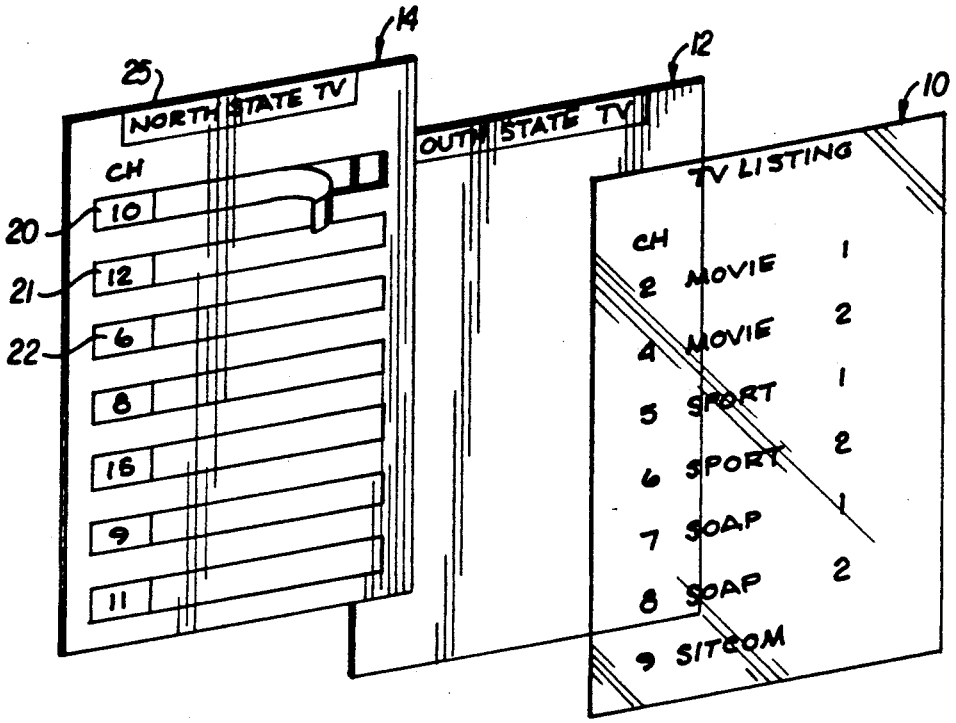
FIG. 1 is a representation of a multi-sheet overlay and a television program listing, in exploded view.

Referring to FIG. 1 a sheet 10 represents a basic grid or listing of television programs broadcast on a particular day, the channels being listed in numerical order. The sheet 12 represents a transparent sheet, which is preferably a plastic sheet. The plastic transparent sheet is combined with a non-transparent or opaque sheet 14 forming a multi-sheet or two sheet overlay. The sheet 14 has an adhesive material 16, on one side of the sheet so that, as more clearly seen in FIG. 2, the sheet 14 may be adhered to its adjacent sheet 12, forming a multi-sheet or two sheet overlay, with removal capability.

The non-transparent or opaque sheet of the overlay is cut so that strips or sections, for example 20, 21, 22, etc. of the opaque sheet may be selectively removed from the overlay, such as represented at 20.

In the trade, when a multi-sheet member is cut so that only one of the sheets of the member is cut, this is referred to as a kiss-cut. In the invention herein, the kiss-cut technique is used to enable a selected section of the overlay to be removed to selectively expose selected data in the basic television listing positioned below the overlay. The kiss-cut sections of the overlay are positioned so as to cover selected data on the listing sheet 10. Thus when the overlay is positioned over the television program grid, selected listed data may be exposed by removing selected kiss-cut sections of the overlay. The opaque sheet 14 may be preprinted on selected kiss-cut section so that television program listing data may be changed from the data on the opaque sheet 14 to the exposed data on the sheet 10. Also the transparent sheet 12 may be preprinted with selected data and removal of a kiss-cut section of the overlay may reveal or expose data printed on the transparent sheet 12.

Figure 3:
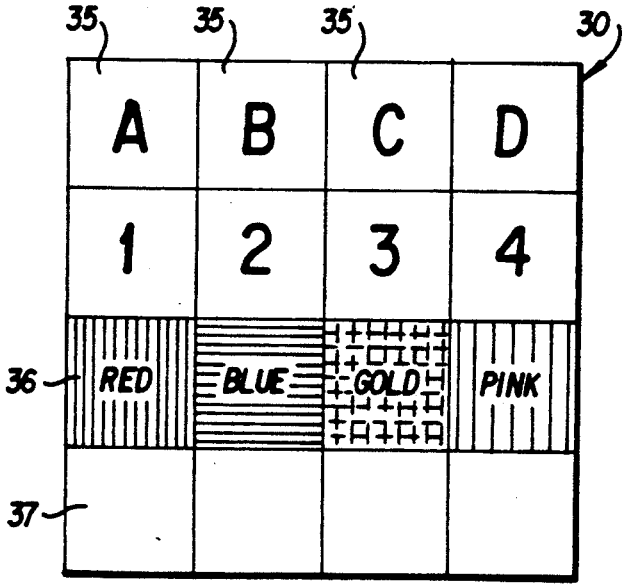
FIG. 3 is a representation of a sheet of stamps.

Supplemental removable data may also be provided, as represented in FIG. 3, where a plurality of stamps, such as peel-off stamps, for example, are represented. These stamps may be used to personalize a television listing for one's personal use. A sheet may include stamps 35, for example, which may be removed from the sheet 30 and attached to the overlay, either on the opaque sheet or the transparent sheet. The stamps may be used to more closely identify one or more television programs by number, by letter or by color, for example or by one's own personal identification marking, marked on a blank stamp.

Part or all of the non-transparent sheet 14 may be printed with data relating to television programs and/or channels in one local television area, for example, Easttown and corresponding portions of the transparent sheet 12 may be printed with data relating television programs and/or channels in another local television area, for example, Westtown, each of which have different and distinguishable television service. Thus, one overlay may be used to service two different local television areas. This is represented by the heading NORTH STATE TV on the sheet 14, in a kiss-cut section, and the heading SOUTH STATE TV on sheet 12 which is revealed or exposed by removing the kiss-cut section.

In the North State TV system, for example, channel 10 may show the program broadcast by channel 2 as indicated on the basic listing or grid. In the South State TV system, for example, channel 9 (not shown) may show the program broadcast by channel 2, listed on the listing sheet 10.

Figure 2:
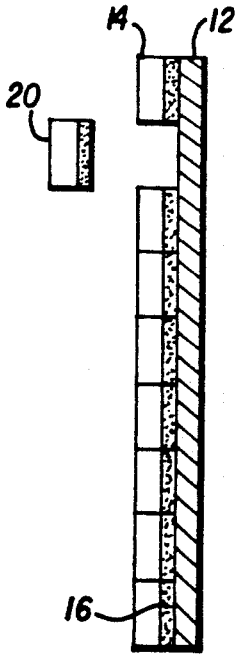
FIG. 2 is a cross sectional view of an overlay of the present invention.

FIG. 2 shows a cross-section view of a multi-sheet overlay where one sheet of the overlay, an opaque sheet, is kiss-cut so that selected sections of the opaque sheet may be removed exposing the undersheet.

The adhesive used to removably adhere sheet 14 to sheet 12 may be the same type or similar to the adhesive used on removable address labels, sometimes referred to as piggy back labels. This is state of the art adhesive material.

There has been shown and described a multi-sheet overlay with removable, kiss-cut sections for amending or changing a television program listing so that the stated programing is associated with local channels which are not numbered the same as the channels identified in the basic listing, with provision for adding supplemental data to the amended television program for personalizing a television program. Changes and modifications may be made, as will become apparent to those skilled in the art, without departing from the invention defined in the claims.

What is claimed is:

1. A multi-sheet information display combination for selectively changing information displayed by said apparatus, said multi-sheet information display apparatus comprising:

a) a first sheet having a first data printed thereon, said first data laid out in a predetermined format;

b) a transparent sheet substantially conforming with said first sheet and covering said first data on said first sheet; and, c) an opaque sheet having a second data printed on a first surface thereof, said second data laid out in said predetermined format, said opaque sheet removably adhered to said transparent sheet by an adhesive means on a second surface of said opaque sheet, said first data and said second data in corresponding position in said predetermined format related to each other and dissimilar, said opaque sheet selectively kiss-cut for removing selective portions of said opaque sheet from said transparent sheet for selectively removing a selected portion of said second data and exposing a related portion of said first data.

2. A multi-sheet information display combination as in claim 1 and in which said first data lists a set of television programs in a first order and first television channels over which the respective television programs are to be broadcast and said second data lists said set of television programs in said first order and second television channels over which said respective television programs are to be broadcast.

3. A multi-sheet overlay combination for personalizing data defining a television program listing, said combination comprising:

a) a first sheet having a first data printed on a first surface thereof, said first data laid out in a predetermined format;

b) a second sheet for overlaying said first sheet, said second sheet including a transparent sheet and a non-transparent sheet, said non-transparent sheet having an adhesive means on a second surface thereof for removably adhering said non-transparent sheet to said transparent sheet, said non-transparent sheet having a second data printed on a third surface thereof, said second data laid out in said predetermined format, said non-transparent sheet being selectively kiss-cut for permitting removal of a selected portion of said non-transparent sheet from said transparent sheet; and, c) said second sheet overlaying said first sheet so that said transparent sheet is positioned on said first surface of said first sheet, said second sheet positioned so that said predetermined format of said first data coincides with said predetermined format of said second data.

4. A multi-sheet overlay combination for personalizing data as in claim 3 and in which said selected portion of said non-transparent sheet includes a portion of said second data printed thereon and removal of said selected portion from said second sheet effectively removes said portion of said second data and exposes a portion of said first data.

5. A multi-sheet overlay combination for personalizing data as in claim 4 and in which said second data is a first color and said first data is a second color.

6. A multi-sheet overlay combination for personalizing data as in claim 4 and in which said second data relates to a first television broadcasting system and said first data relates to a second television broadcasting system.

7. A multi-sheet overlay combination as in claim 3 and in which said first data is printed in a first color and said second data is printed in a second color.

8. A multi-sheet overlay combination as in claim 3 and in which removal of said selected portion removes a portion of said second data and exposes a portion of said first data.

9. A multi-sheet overlay combination as in claim 8, and in which said transparent sheet is a colored sheet and said first data appears in color.

10. A multi-sheet overlay combination for amending related data contained on said apparatus, said multi-sheet overlay apparatus comprising:

a) a first sheet having a first data printed on a first surface of said first sheet, said first data laid out in a predetermined format;

b) a second sheet having a second data printed on a second surface of said second sheet, said second data laid out in said predetermined format, said first data and said second data in corresponding position in said predetermined format related to each other, and at least a portion of said first data being dissimilar to a corresponding portion of related said second data;

c) a transparent sheet disposed between said first surface of said first sheet and a third surface of said second sheet, covering said first data on said first sheet, said second sheet adhered to said transparent sheet by an adhesive means on said third surface of said second sheet, said transparent sheet positioned on said first sheet so that said predetermined format on said second sheet is superimposed on said predetermined format on said first sheet; and, d) said second sheet selectively kiss-cut for removing selected portions of said second sheet from said transparent sheet for removing a selected second data and exposing a selected first data.

11. A multi-sheet overlay combination as in claim 10 and in which said adhesive means is a pressure sensitive adhesive mounted on said third surface of said second sheet and permits removal of said second sheet from said transparent sheet.

12. A multi-sheet overlay combination as in claim 10 and in which said first data lists a plurality of television programs and a set of first channels over which said plurality of television programs are to be broadcast and said second data lists said plurality of television programs and a set of second channels over which said plurality of television programs are to be broadcast.

13. A multi-sheet overlay combination as in claim 12 and further including a means for coloring said transparent sheet exposed after removal of a kiss-cut segment of said second sheet from said transparent sheet for color coding said selective first data.

* * * * *